United States Patent [19]

Thompson

[11] 4,446,991

[45] May 8, 1984

[54] SELF-CONTAINED FLUID DISPENSER

[76] Inventor: Kenneth W. Thompson, Box 1455, Bartlesville, Okla. 74003

[21] Appl. No.: 299,997

[22] Filed: Sep. 8, 1981

Related U.S. Application Data

[63] Continuation-in-part of Ser. No. 39,947, May 16, 1979, Pat. No. 4,324,350.

[51] Int. Cl.[3] ..... B67D 5/06; B67D 11/00

[52] U.S. Cl. ..... 222/94; 222/131; 222/386.5; 222/183; 220/85 B

[58] Field of Search ..... 222/211, 212, 386.5, 222/131, 183, 387, 92, 94, 107, 130, 206, 215; 220/85 B; 138/28, 30; 215/1 C; 150/0.5; 206/DIG. 805

[56] References Cited

U.S. PATENT DOCUMENTS

| | | | |
|---|---|---|---|
| 3,876,115 | 4/1975 | Venus, Jr. et al. | 222/183 |
| 3,940,026 | 2/1976 | Kain | 222/212 |
| 4,222,499 | 9/1980 | Lee et al. | 222/183 |
| 4,324,350 | 4/1982 | Thompson | 222/212 |

*Primary Examiner*—David A. Scherbel
*Assistant Examiner*—Russell D. Stormer
*Attorney, Agent, or Firm*—Head, Johnson & Stevenson

[57] ABSTRACT

A self-contained fluid dispenser comprising an elongated tubular expandable unit of elastomeric material having a closed end and an opposite open end, the open end being provided with a neck piece having a recess for sealingly supporting a valve and valve support plate, the material around said recess being thickened to prevent significant stretching around the valve support, the tubular unit being tapered to provide a thinner wall at the closed end thereof to insure complete filling of the unit. One embodiment includes an annular flange portion for sealing the neck piece to the valve support. One embodiment comprises a plurality of annular ribs made separately or as an integral part of the tubular unit for controlling the shape and pressure of the expanded tubular unit.

15 Claims, 6 Drawing Figures

SELF-CONTAINED FLUID DISPENSER

CROSS-REFERENCE TO RELATED APPLICATION

This is a continuation-in-part of co-pending application Ser. No. 39,497, now U.S. Pat. No. 4,324,350 filed May 16, 1979 for "Apparatus For Pressure Dispensing of Fluid".

BACKGROUND OF THE INVENTION

1. Field of the Invention

The present invention relates to fluid dispensing devices and more particularly, but not by way of limitation, to a gasless, one-piece pressure dispensing tubular unit of elastomeric material, the pressure of which is created by the elastomeric properties of the material after the unit has been expanded by forcing fluid products into the unit under pressure.

2. History of the Prior Art

Pressurized containers for dispensing fluids have achieved a high degree of popularity for handling many types of fluids ranging from sprayable liquids to extrudable viscous fluids. In the prior art, most of the dispensers have utilized a propellant gas for pressurizing the fluid. The cost of the propellant gas is a considerable part of the cost of the device and occupies much of the space that could be used for housing the product. Further, the chemical nature of the propellant gasses used has been found and is believed to be damaging to the environment.

Efforts have been made to utilize elastic bags for the dispensing of fluid in order to obviate the use of propellant gasses. Typical of these attempts are teachings found in the patent to Kain, U.S. Pat. No. 3,940,026, issued Feb. 24, 1976 to Calvin L. Kain.

There has been extreme difficulty in attaching such elastomeric bags to existing valve structures to prevent damage to the bag itself and provide an effective system for dispensing the product.

Further, in the case of elastic bags having uniform cross-sectional shape, the bags tend to expand only in the middle part thereby filling only a portion of the bag leaving the ends unexpanded similar to that experienced in blowing up a new balloon wherein the end portion does not become filled with air.

The net result of these efforts has left the propellant gas dispensing units on the market, along with hand-operated pumps, which are less convenient to use and more difficult to manufacture due to the moving parts associated with such pumps.

SUMMARY OF THE INVENTION

The present invention provides a self-contained, one piece fluid dispenser which does not utilize a propellant gas. The dispenser comprises a specially shaped tubular unit made of elastomeric material in which the driving force for dispensing a fluid product is the elastic return force of the tubular unit after having been distended by the introduction of the product therein under pressure.

The tubular unit, in its relaxed form has a substantially cylindrical interior wall, the outside wall being tapered toward a closed end so that the wall thickness at the closed end is less than that at the opposite open end.

Thus, when a fluid product is being forced into the unit under pressure, the bottom will expand first, gradually expanding until the unit has been filled. The amount of fluid that may be contained in the unit will depend on the size of the unit and the return pressure exerted will depend primarily on the thickness or composition of the material.

Further, since the lower or closed end portion of the tubular unit fills first, it necessarily follows that it will be the last portion to empty thereby maintaining the center of gravity of a partially filled unit toward the lower portion of the tubular unit or container making the unit generally more stable.

Size and pressure limitations are also encountered in that it is desired to maintain a substantially constant pressure regardless of the amount of fluid product left in the elastomeric unit. Hence, although quite a lot of products might be contained in any one size elastomeric bag, some diminishing results would be obtained by overfilling the bag to the extent that one would experience rather high pressure when the bag is full, diminishing to a lower pressure when the bag is nearly empty.

The opposite open end of the tubular unit is provided with a flared portion hereinafter referred to as the neck portion which is constructed of the same elastomeric material but of a thickness to resist stretching when the unit is filled. This neck portion is in the form of a truncated conical shape which forms a recess for receiving a valve and valve support thereagainst.

In one embodiment a thin-walled tubular extension is secured to and made an integral part of the outer portion of the neck, the end thereof being provided with a curved flange therearound for securing the tubular unit to readily available valve support structures.

The standard valve support used in aerosol containers comprising a valve cup having a curved flange portion which is crimped around a toroidal ring carried by the crown of the pressure container.

In the present invention the tubular flange is sandwiched between the flange of the valve support and the toroidal ring obviating the necessity for using any adhesives or separate clamping members. Also, since the container for the present invention does not have to support pressure itself, it may be of any suitable construction, or for that matter, may not even be required.

The crimping of the tubular flange is sufficient for securing the tubular unit to the valve support since the thickened portion thereof removes substantially all loading except for tension loads in the tubular extension portion.

A second embodiment teaches a modified valve support which is molded into the tubular expandable unit by a twopart centrifugal molding process thereby producing a self-contained device which may then be inserted into a housing or can.

A plurality of transverse angular ribs may be provided along the length of the tubular unit to achieve a desired increased return pressure and to regulate the shape of the expanded unit when filled. Naturally, the thickness of the material itself also determines return pressure.

The filling of the unit with a product may be accomplished in the well-known manner of filling under pressure through the valve carried by the valve support cup or plate.

Although the tapered construction of the tubular unit and associated neck piece could be used with other valve designs, the present configuration of the tubular extension portion permits the use of off-the-shelf valve and valve support designs and existing filling equipment thereby making the transition to the present system less costly.

DESCRIPTION OF THE DRAWINGS

Other and further advantageous features of the present invention will hereinafter more fully appear in connection with a detailed description of the drawings in which.

DESCRIPTION OF THE PREFERRED EMBODIMENTS

Figure 1:
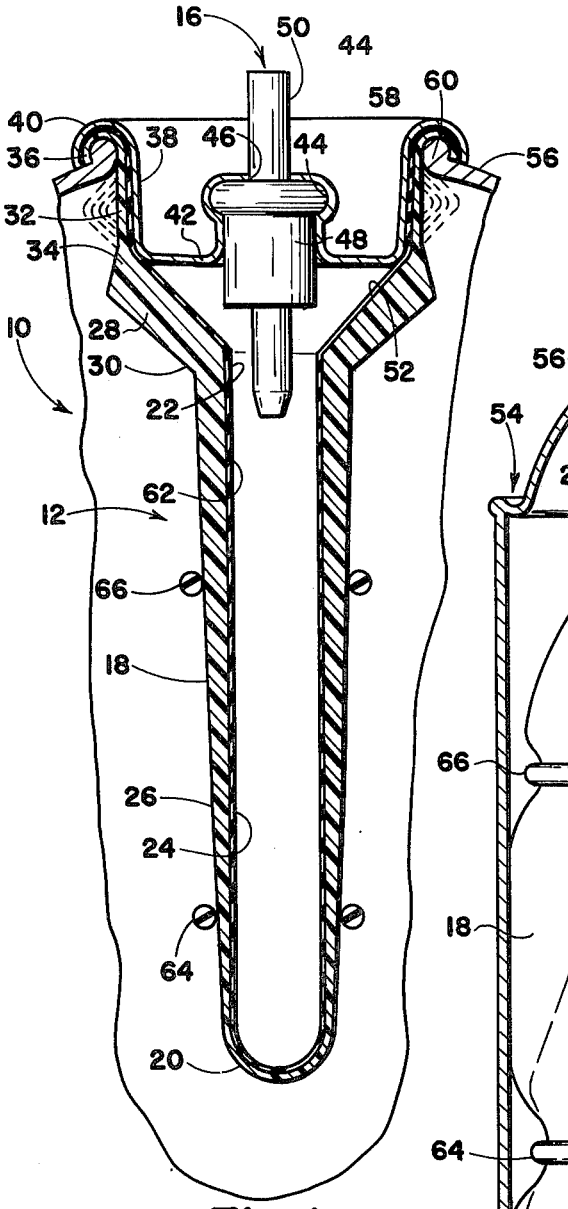
FIG. 1 is an elevational sectional view of a fluid pressure dispensing apparatus embodying the present invention.

Referring to the drawings in detail, reference character 10 generally indicates a self-contained pressure dispensing apparatus generally comprising a tubular expandable unit 12 made of elastomeric material, a valve support mechanism 14 and associated push-button valve 16 carried thereby.

The elastomeric tubular unit 12 comprises an elongated tubular unit 18 having a closed end 20 and an opposite open end 22. The tubular unit comprises an inside wall 24 having substantially uniform diameter throughout the length of the unit 18, the outer wall 26 thereof being tapered from the open end 22 inwardly toward, and including, the closed end 20 so that the wall thickness near the closed end 20 is less than the wall thickness at the open end 22. However, it is noted that the important feature is the tapered wall thickness, rather than the cylindrical inner wall. The tubular unit 12 further comprises a truncated conical shaped neck portion 28 having a smaller end 30 secured to the open end 22 of the tubular unit 18 and made as an integral part thereof. The neck portion 28 is considerably thicker in construction to resist stretching for a purpose that will be hereinafter set forth.

A tubular extension portion 32 of a thinner elastomeric material is secured to a larger end 34 of the neck portion 28 and made as an integral part thereof. The tubular extension portion 32 is provided with an outwardly curved flange portion 36 around the outer edge thereof.

The valve support plate or cup 14 generally comprises a cylindrical side wall 38 terminating around the outer edge thereof with an outwardly curved flange portion 40. The lower or inner end of the wall 38 is provided with a base plate 42 having a shaped recess 44 therein for receiving the push-button valve member 16 therein. The recess 44 of the plate 42 is provided with an aperture 46 therein.

The push-button valve member comprises a valve body 48 having an outwardly extending movable stem 50 which is inserted through the aperture 46. The valve stem 50 extends through the valve body 48 into a recess 52 formed by the shape of the neck portion 28 of the tubular unit.

Figure 2:
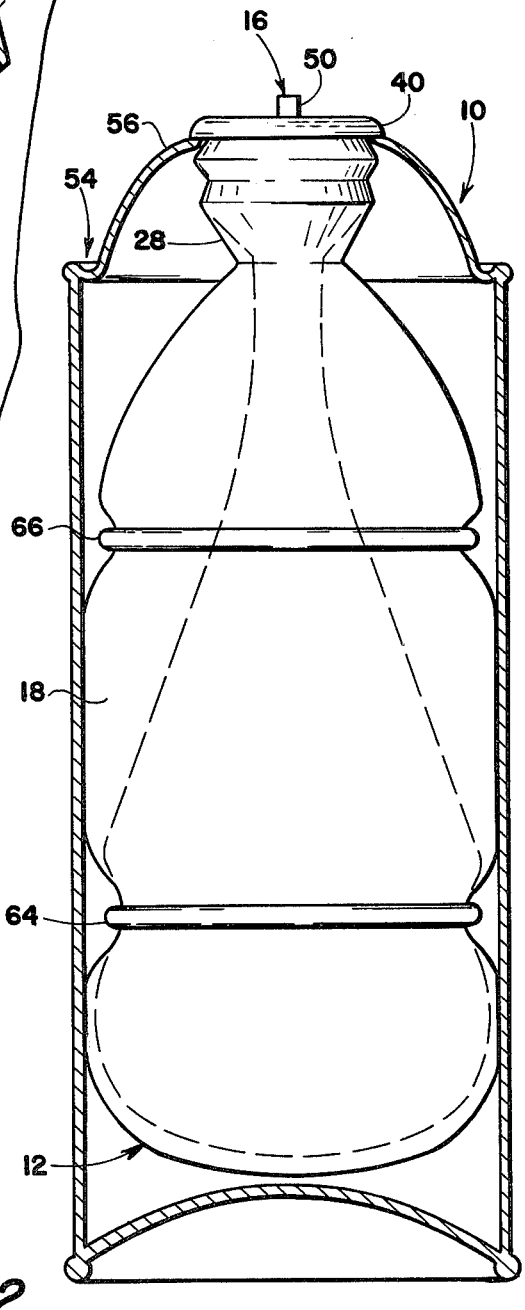
FIG. 2 is a partial sectional view of the dispenser of FIG. 1 in an expanded or filled configuration.

Referring to FIG. 2 of the drawings, reference character 54 generally indicates a tubular housing or container having a top dome portion 56 for carrying the valve support 14. The dome portion 56 has a central opening 58, the interior thereof being molded into a toroidal ring 60.

The interior of the tubular unit 12 is provided with a thin wall liner 62 which may be as a separate stretchable plastic or rubber liner or may comprise a coating of elastic material to the interior wall thereof to provide chemical resistance or a chemical barrier between the product carried within the tubular unit and the elastomeric material making up the tubular unit.

In connecting the valve support 14 and associated valve 16 to the tubular unit 12, the valve support is lowered into place so that the plate 42 thereof is in contact with the neck portion 28 of the tubular unit, the tubular extension 32 either resting directly against the wall 38 of the valve support or with the liner 62 therebetween. The curved flange portion 36 of the tubular extension is placed to partially surround the toroidal ring 60 of the container with the curved flange portion 40 of the valve support also fitting therearound as shown in FIG. 1.

In order to clamp the units together, the inside walls 42 of the valve support plate are swedged outwardly as shown by the dashed lines in FIG. 1 which firmly secures the elastomeric unit 12 to the valve support. It is noted at this point that the toroidal ring 60 may be a separate ring apart from the container 54 or made as an integral part of the container 54.

In order to control the expanded shape and return pressure of the tubular unit 12, a plurality of annular rib members 64 and 66, which are also made of elastomeric material, may be simply positioned along the outer wall 26 of the tubular unit at desired locations.

The use of the annular rings 64 and 66 of elastomeric material as shown in FIG. 1 would permit the manufacture of a single elastomeric unit 12 for several different pressure and shape applications. For example, if an elongated slender shape is desired, several rib members 64 and 66 may be distributed along the length of the elastomeric unit thereby confining the transverse expansion of the unit 12. On the other hand, if increased pressure is desired, elastomeric rib members 64 and 66 may be added which would provide greater return pressure.

A typical example of an expanded unit disposed in an ordinary aerosol container is depicted in FIG. 2. The dashed lines of FIG. 2 indicate the elastomeric unit in a partially filled configuration depicting the filling of the unit taking place in the bottom portion first, which also would be the last portion to empty upon dispensing the fluid therefrom.

Figure 3:
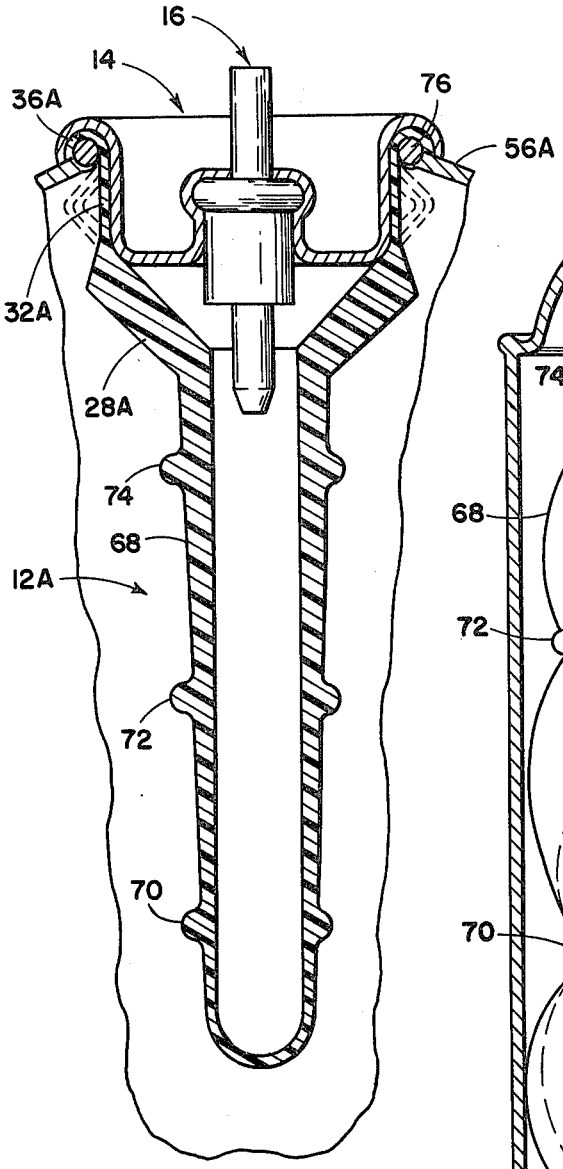
FIG. 3 is a sectional elevational view of a second embodiment of the dispenser apparatus embodying the present invention.
Figure 4:
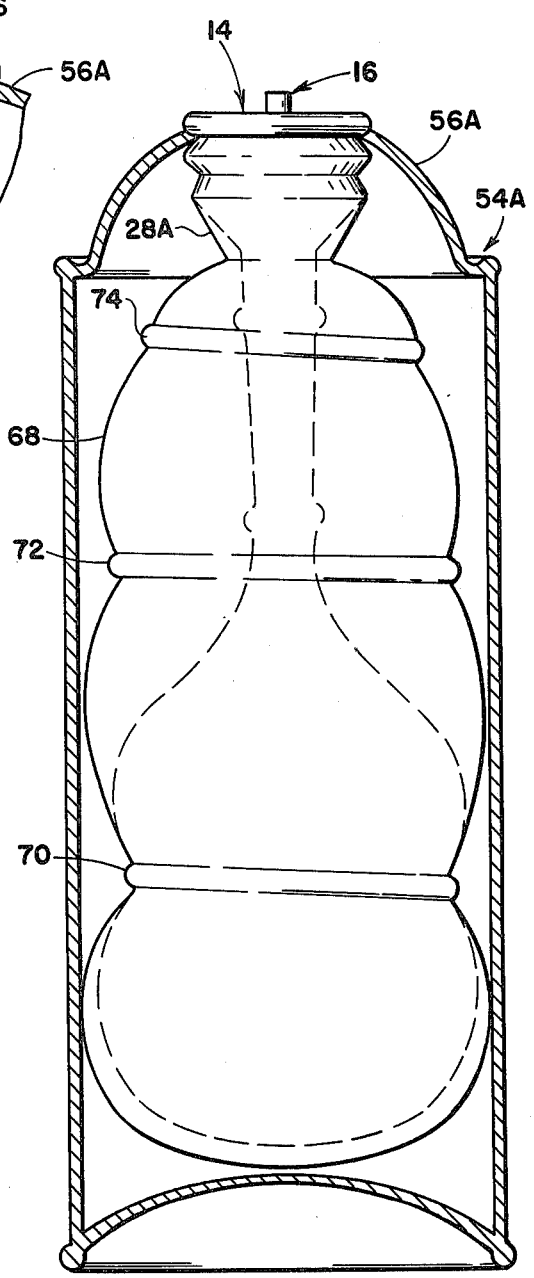
FIG. 4 is a partial sectional elevational view of the device of FIG. 3 in an expanded condition.

Referring now to FIGS. 3 and 4 of the drawings, reference character 12A generally indicates a second embodiment of the elastomeric unit 12 secured to the same valve support 14 and valve mechanism 16.

The elastomeric unit 12A comprises an elongated tubular portion 68 again having a tapered sidewall. The elongated tubular portion 68, however, is provided with a plurality of rib members 70, 72 and 74, which are constructed as an integral part of the elongated member 68. The unit 12A comprises a substantially identical neck portion 28A, a tubular extension 32A and curved flange portion 36A, all substantially identical to the elastomeric unit 12.

Common reference characters have been utilized throughout FIGS. 3 and 4 for the remaining components which are substantially identical to those hereinbefore described.

In this particular embodiment, a container 54A is provided with a dome or end portion 56A having a toroidal ring 76 mounted in the opening thereof. In this case the toroidal ring 76 is depicted as a separate component that may be either welded to the container dome 56A or may be constructed as a separate component for the attachment of the unit 12A directly to the valve support 14 without the use of the container 54A at all.

Figure 6:
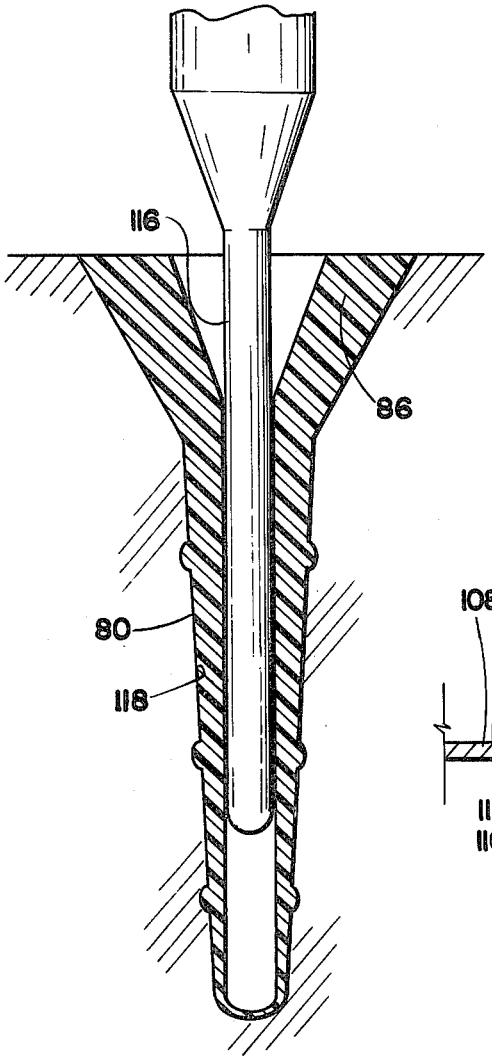
FIG. 6 is a partial sectional view of the device of FIG. 5.
Figure 5:
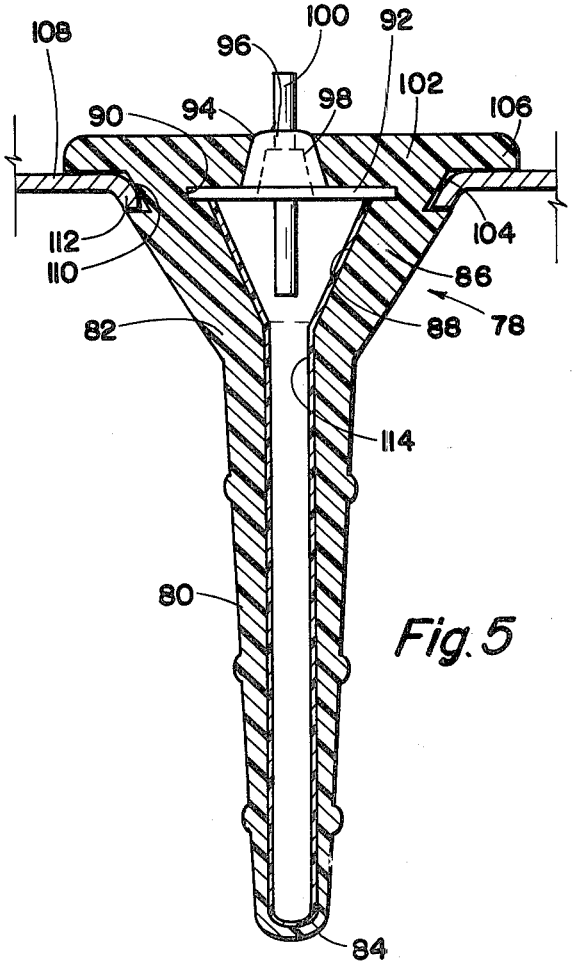
FIG. 5 is an elevational sectional view of a fluid dispenser representing a second embodiment of the invention.

Referring now to FIGS. 5 and 6 of the drawings, reference character 78 generally indicates an expandable self-contained pressure unit for the dispensing of fluid comprising a tubular expandable unit 80 made from elastomeric material having a first open end 82 and an opposite closed end 84. The wall thickness of the tubular unit 80 at the open end 82 being thicker than the wall at the closed end 84.

A truncated conical shaped neck piece 86 is secured to the open end 82 thereof and made as an integral part thereof. The interior of the neck piece forms a recess at 88 for a purpose that will be hereinafter set forth. The recess of the neck piece 86 further comprises an annular internal groove 90 around the top portion thereof for receiving a valve support plate 92 thereon. The valve support plate 92 is provided with an upwardly extending boss 94 having an aperture 96 therein.

A valve unit 98 is disposed within the boss 94 having a stem member 100 which extends through the aperture 96 for dispensing a fluid product (not shown) contained within the elastomeric unit 80. An extension 102 of elastomeric material is molded directly to the top of the neck piece 86 whereby the valve support plate 92 is firmly held in place as shown in FIG. 5.

An external annular groove 104 is provided around the outer periphery of the upper end of the neck piece, the top of the extension 102 being provided with an enlarged flange portion 106.

The unit 78 may be installed in a housing having a top portion 108 and a central aperture 110 therein. The edge of the container forming the aperture 110 is turned down slightly at 112 to form a lip for a purpose that will be hereinafter set forth.

To install the self-contained pressure unit 78 in the housing, the unit is inserted in the housing until the downwardly turned lip portion 112 of the housing or container top 108 rests within the external annular groove 104 as shown in FIG. 5.

A liner material 114 is provided along the internal walls of the tubular unit 80 and neck piece 86. The liner 114 is provided by coating the said internal surface of the tubular unit with an elastic material which serves as a chemical barrier between the product contained within the container and the elastomeric material making up the tubular unit 80 and neck piece 86.

Construction of the elastomeric unit may be accomplished by molding the tubular unit 80 and neck piece portion 86 with a removable mandrel 116 being centrally disposed within a mold cavity 118. Once the lower unit is molded as shown in FIG. 6, the mandrel 116 is withdrawn and the interior surface of the unit is coated with the liner material 114, if needed.

The valve support plate 92 and associated valve 98 are then inserted into contact with the top of the neck piece 86 and the molding process is continued to add the extension 102 and flange 106 thereon.

The entire self-contained unit is then withdrawn from the mold cavity 118 and cured by a suitable curing process.

From the foregoing it is apparent that the present invention provides a self-contained, gasless fluid dispensing mechanism which is usable with existing valve systems and a variety of containers, or on the other hand, it is usable without the need for a container at all. For example, the container shown in the drawings attached hereto indicates a bottom portion as typically found in containers on the market which utilize a gas propellant. In the present invention there would be no need for a bottom in the container since it is not required to withstand any pressure exerted by the expandable elastomeric unit.

Whereas the present invention has been described in particular relation to the drawings attached hereto, other and further modifications apart from those shown or suggested herein may be made within the spirit and scope of the invention.

What is claimed is:

1. A self-contained fluid dispensing apparatus comprising an elongated tubular expandable unit of molded elastomeric material closed at a bottom end thereof and open at the opposite end;

an integral widened neck portion at the open end having an enlarged internal and external diameter and being integrally formed of thickened elastomeric material to resist stretching thereat;

an extension of elastomeric material beyond said thickened and enlarged diameters neck portion and integral with the neck portion;

a valve support plate means disposed across the neck portion; and a fluid dispenser valve inserted through and sealed to the valve support plate means, said valve support plate means being sealed to the neck portion extension for closing the open end of the expandable unit.

2. A fluid dispenser as set forth in claim 1 wherein the valve support plate is molded between the neck portion and the extension.

3. A fluid dispenser as set forth in claim 2 and including a tubular housing having an open top portion, and wherein the expandable unit neck portion comprises an annular groove for securing the expandable unit to the open top portion of the housing.

4. A fluid dispenser as set forth in claim 1 wherein the wall thickness of the tubular expandable unit at the open end is greater than the wall thickness at the closed end.

5. A fluid dispenser as set forth in claim 4 and including a plurality of spaced annular constricting members encircling the tubular expandable unit for generally controlling the shape and return pressure of the unit when it is expanded.

6. A fluid dispenser as set forth in claim 5 wherein said annular ribs are made as an integral part of said tubular elastomeric material.

7. A self-contained fluid dispensing apparatus comprising an elongated tubular expandable unit of elastomeric material having tapered wall thickness from a thicker open end to an opposite thinner closed end;

a neck portion at the open end thereof of an increased thickness of elastomeric material for resisting expansion, a recess in said neck portion, said neck portion being made as an integral part of the tubular unit;

a valve support plate carried by the neck portion and attached to and sealed across the open end of the expandable unit;

a tubular extension of thin elastomeric material secured to the neck piece and made as an integral part thereof, the outer edge of said tubular extension comprising a tubular neck flange;

a fluid dispenser valve inserted through and sealed to the valve support plate means; and a toroidal support ring for sealing the tubular neck flange to the valve support means, whereby said fluid to be dispensed is forced into the expandable unit through the valve causing filling and expansion of the unit from the first closed end thereof.

8. A fluid dispenser as set forth in claim 7 wherein the neck portion is of a truncated conical shape, the small end thereof joining the open end of the tubular expandable unit, the tubular extension portion being secured to the larger end of the neck portion and having a diameter compatible with the size of the valve support plate means for snugly receiving the support plate means therein.

9. A fluid dispenser as set forth in claim 7 and including a liner throughout the interior of the expandable unit, neck portion and tubular extension for providing a chemical barrier between fluids carried therein and the elastomeric material.

10. A fluid dispenser as set forth in claim 9 wherein the liner comprises a coating of elastic material covering said interior of the expandable unit, neck portion and tubular extension.

11. A fluid dispenser as set forth in claim 7 wherein the tubular extension and associated flange has a wall thickness considerably less than the neck portion and comprises a first cylindrical base section compatible in shape and size with said valve support means, the flange portion comprising an outwardly curved lip portion for partially encircling the toroidal ring.

12. A fluid dispenser as set forth in claim 11 and including a tubular housing having an open top portion, said toroidal ring being secured to the open top portion, the expandable unit being disposed within the housing.

13. A pressure dispenser as set forth in claim 7 and including a plurality of spaced annular ribs of elastomeric material encircling the tubular expandable unit for generally controlling the shape and return pressure of the unit when it is expanded.

14. A pressure dispenser as set forth in claim 13 wherein said annular ribs are made as an integral part of said tubular elastomeric material.

15. A self contained fluid dispenser comprising an elongated tubular expandable unit of elastomeric material having an open end and an opposite closed end, the wall thickness at the open end being greater than the wall thickness at the closed end, said thickness uniformly varying from the open end to the closed end, a truncated conical shaped neck portion having the smaller end thereof secured to the open end of the expandable unit and made as an integral part thereof, said neck portion being of a thick wall construction to resist stretching when the unit is expanded, a tubular neck extension of thin wall construction secured to the large end of the neck portion and made as an integral part thereof, said tubular neck extension having a curved flange portion around the outer edge thereof, a valve means disposed within the tubular extension and in contact with the neck portion, said valve means comprising a curved flange compatible with the tubular extension flange and a toroidal ring, said valve means being crimped around said toroidal ring, the tubular extension flange portion being sandwiched therebetween.

* * * * *